US005918850A

United States Patent [19]

Domange et al.

[11] Patent Number: 5,918,850

[45] Date of Patent: Jul. 6, 1999

[54] DEVICE FOR POSITIONING AT LEAST ONE FIXED POINT IN A CIVIL ENGINEERING STRUCTURE AND USE IN SUCH STRUCTURES

[75] Inventors: Bruno Domange, Maisons Laffitte; Alfred Krief, Maurepas, both of France

[73] Assignee: Jarret, France

[21] Appl. No.: 08/882,305

[22] Filed: Jun. 25, 1997

[30] Foreign Application Priority Data

Jun. 26, 1996 [FR] France ..... 96 07952

[51] Int. Cl.[6] ..... F16M 13/00

[52] U.S. Cl. ..... 248/636; 248/562

[58] Field of Search ..... 248/559, 562, 248/636, 638, 678; 14/73, 73.1, 73.5; 52/167 R, 167 RM

[56] References Cited

U.S. PATENT DOCUMENTS

| | | | |
|---|---|---|---|
| 4,402,483 | 9/1983 | Kurabayashi et al. | 248/636 |
| 4,944,482 | 7/1990 | Bouhier et al. | 248/559 |
| 5,149,066 | 9/1992 | Snaith et al. | 248/636 |
| 5,169,110 | 12/1992 | Snaith et al. | 248/636 |
| 5,197,707 | 3/1993 | Kohan | 248/636 |

FOREIGN PATENT DOCUMENTS

| | | |
|---|---|---|
| 2544432 | 10/1984 | France . |
| 2683558 | 5/1993 | France . |
| 3047762 | 7/1982 | Germany . |
| 625302 | 9/1981 | Switzerland . |

*Primary Examiner*—Ramon O. Ramirez
*Assistant Examiner*—Robert Lipcsik
*Attorney, Agent, or Firm*—Rothwell, Figg, Ernst & Kurz, P.C.

[57] ABSTRACT

A device for positioning in a civil engineering structure at least one fixed point which, in normal time, locks a point of part of the structure in position relative to another, supporting, part which is considered fixed. In order to return the structure part to its initial position as soon as the disturbing action thereon ceases, the device (32) comprises at least two prestressed damping springs which are mounted in opposition either side of the fixed point and act, first, on the structure part which can move in relative manner, such as a bridge floor (10) and, second, on a structure part considered fixed, such as a bridge pier (11).

14 Claims, 3 Drawing Sheets

DEVICE FOR POSITIONING AT LEAST ONE FIXED POINT IN A CIVIL ENGINEERING STRUCTURE AND USE IN SUCH STRUCTURES

BACKGROUND OF THE INVENTION

1. Field of the Invention

The invention concerns a device for positioning at least one fixed point in a civil engineering structure and also relates to the use of such a device in the holding of such structures.

2. Description of Related Art

Civil engineering structures such as bridges or viaducts in particular comprise, first, supports which are connected to the ground and are considered fixed and, second, steel or concrete parts, such as bridge floors which rest on these supports and are subject to thermal expansion and, in the case of a concrete bridge floor, to contraction and creep.

In structures of this type, there are thus both fixed supports and one or a plurality of structure parts, such as one or a plurality of bridge floors, of which the length varies during the course of the year, such that the length of an 800 m bridge may vary by 400 mm for example. This continuous variation in length therefore gives rise to a relative movement between the bridge floor, which expands or contracts, and its supports, for example the pier heads which support the bridge floor.

In order to take account of these factors, the connection between the bridge floor and pier head is generally brought about by supports with sliding casings, having a low coefficient of friction, or by resilient supports and/or rigid mountings between the bridge floor and pier head, so as first to enable the bridge floor to expand and contract freely relative to the piers and supports supporting it and second to provide a fixed point somewhere on the bridge floor in order to prevent the latter's being able to move uncontrollably.

In order to comprehend the invention better, the essential means used according to the prior art will be described first with reference to FIGS. 1 to 6, whilst the invention will be described with reference to FIGS. 8 and 9, FIG. 7 explaining the result sought both by the prior art and the invention.

One of the fundamental problems posed is that of producing a fixed point which, in the case of a bridge floor for example, will ensure that said floor can expand and contract freely during the course of the year but will not move as a single unit and maintains a fixed anchorage point. If the fixed point is formed for example at a connection between one of the bridge piers and a corresponding point of the bridge floor and no particular precautions are taken, in the event of an earthquake, for example, since the pier cannot hold the bridge, the bridge will collapse under the effect of the movement caused by the pier. If, in order to avoid this problem occurring, the fixed support is designed such that, if stresses which are too great are applied, the fixed support is destroyed, for example as a result of the shearing of a retaining key, the problem will then be that the associated displacement movement of the bridge floor cannot be controlled and that, in the event of aftershocks, there will no longer be any fixed support at all to hold the bridge floor.

SUMMARY OF THE INVENTION

According to the invention, the device for positioning at least one fixed point in a civil engineering structure equipped with devices of known type, such as sliding supports, which support the structure whilst allowing the latter a given degree of freedom relative to its supports, in particular the thermal expansion movements such as those of a bridge floor, the device in normal time locking in position a point of one structure part relative to another, supporting, part which is considered fixed, such as a bridge pier or some other support, is characterized in that it is designed first to allow the displacement of this point when unusual stresses are applied, such as those which are due to an earthquake, a train stopping in an emergency on a bridge or some other disturbance, and second to return the structure part to its initial position as soon as the disturbing action ceases, the device comprising at least two prestressed damping springs which are mounted in opposition either side of the fixed point and act first on the structure part which moves in a relative manner, such as a bridge floor, and second on a structure part considered fixed, such as a bridge pier, the prestressing of the springs thus being calculated such that, when unusual stresses are not applied, the device maintains the two parts of the structure in a fixed relative position at this point.

It will be appreciated that, depending on which of these means is selected, the use of two prestressed springs mounted in opposition produces in normal time an "imaginary" fixed point, the prestressing force of the springs preventing any relative displacement between the two parts of the structure at this location when usual stresses are applied whereas in the event of unusual stresses being applied, the interposition of the springs enables the movable part of the structure to be displaced relative to the fixed part, whilst ensuring that this movement is damped whereas, when the disturbing action has ceased, the prestressed springs having sufficient force can return the movable part of the structure to its initial position to recreate the imaginary fixed point of the structure at the same location.

The invention likewise applies to structures, in particular bridges, which have bridge floors resting on piers or supports and comprise a positioning device of the type according to the invention.

U.S. Pat. No. 4,402,483 concerns a device which, at first sight, may seem similar to the device according to the invention.

However, the device described in this patent is of a completely different type. It substantially comprises a support plate, designated 2 in FIGS. 1 and 2 and 22 in FIGS. 4 and 5, which is enclosed in an annular contour considered fixed and designated 4 in FIGS. 1 and 2 and 24 in FIGS. 4 and 5, the support plate remaining centred in the annular ring by means of prestressed springs 5, 25 which are mounted in opposition, with shock absorbers 6, 26 mounted in parallel manner.

Usually, the device is adapted to protect fragile machines such as computers, emergency dynamos and dangerous objects (column 1, lines 11 and 12) from shocks which are due in particular to earthquakes. The device according to U.S. Pat. No. 4,402,483 can also be used for larger objects. In this case a plurality of balancing units support a common support plate (column 5, line 65 to column 6, line 8).

It is therefore understood that, contrary to the invention:

- the U.S. patent does not describe a device having a "virtual" fixed point and, in the case of a large object such as, for example, a bridge floor, there would be no special fixed point since each of the devices works in parallel to deaden shocks and return the structure to its initial position when the shock has ceased;
- the device according to U.S. Pat. No. 4,402,483 supports the structure whilst the device according to the invention does not support the structure but simply positions the anchorage point of the structure at a desired location.

In other words, the devices are very different in terms of their structures and in no way fulfil the same function.

BRIEF DESCRIPTION OF THE DRAWINGS

The invention and its implementation will be understood more clearly from the following description which is given with reference to the attached drawings provided solely by way of example and wherein.

DESCRIPTION OF THE PREFERRED EMBODIMENTS

Figure 1:
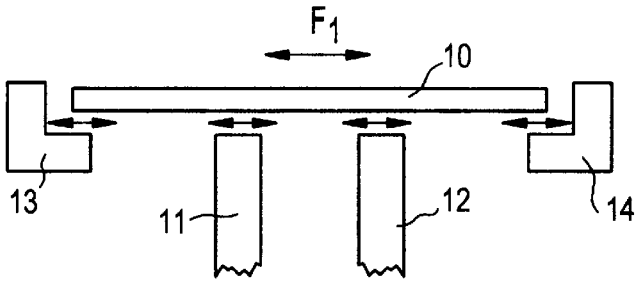
FIG.1 PRIOR ART
FIG. 1 is a schematic view illustrating the manner in which a bridge floor rests on two piers between two supports at each end of the bridge floor, in a general manner.

Referring first to FIG. 1, 10 designates a bridge floor resting on two bridge piers 11 and 12 and, at its ends, on two supports 13 and 14. The double arrows in FIG. 1 indicate the possible relative movements of the bridge floor relative to the piers 11 and 12 and to the supports 13 and 14.

Figure 2:
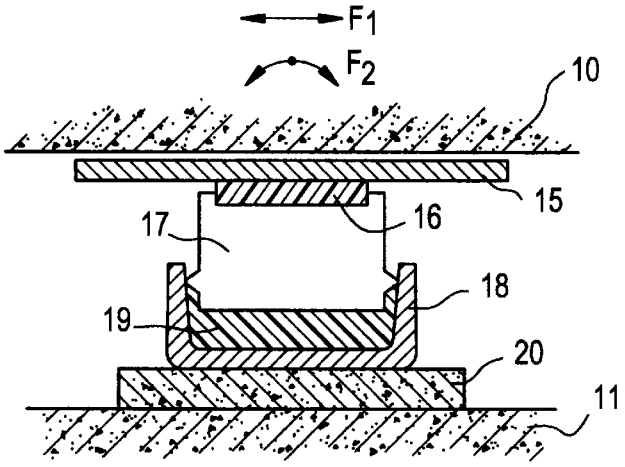
FIG.2 PRIOR ART
FIG. 2 shows a prior art device enabling a bridge floor to move on a bridge pier in order to allow the phenomena of thermal expansion and contraction as well as those of contraction and creep to occur.

FIG. 2 shows a conventional construction in which the bridge floor 10, resting on the head of a bridge pier 11, bears via a stainless steel plate 15, a Teflon (TM) plate 16, a piston 17 resting in a cup 18 with the interposition of an elastomer 19, on a plate 20, for example made of concrete and laid on the pier head 11.

As indicated by the double arrows F1, F2, this construction permits the free sliding displacement, in particular in the longitudinal direction, of the bridge floor 10 relative to the bridge pier 11 and a given vertical damping movement by means of the piston 17 which compresses the elastomer 19.

Figure 3:
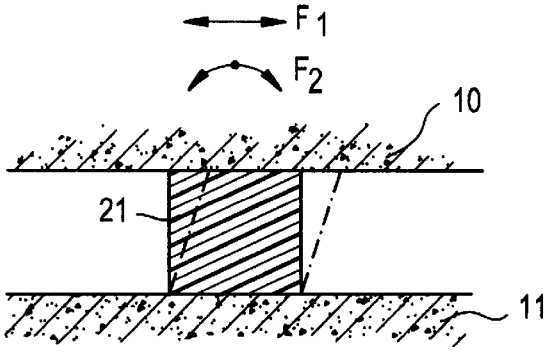
FIG.3 PRIOR ART
FIG. 3 shows a further prior art device substantially enabling the same effects as in FIG. 2 to be achieved.

FIG. 3 shows schematically a further prior art embodiment in which the bridge floor 10 rests on the head of the bridge pier 11 by means of a rubber block 21, for example of the neoprene type. The deformation of this block, for example towards the right-hand side as shown by the broken lines, also permits a certain degree of freedom, allowing a limited displacement of the bridge floor 10 relative to the bridge pier 11 and a slight vertical movement depending on the greater or lesser degree of compression under load of the neoprene block.

Figure 4:
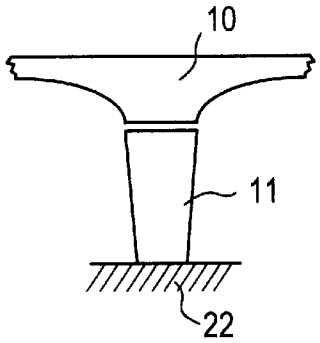
FIG.4 PRIOR ART
FIGS. 4, 5, and 6 show a prior art device of the key type enabling the same effects to be achieved and being able to produce a fixed point for the structure according to a variant which is not shown but will be described briefly.

FIG. 4 shows schematically the assembly of the bridge floor 10 on a bridge pier 11 which itself rests on the ground 22.

Figure 5:
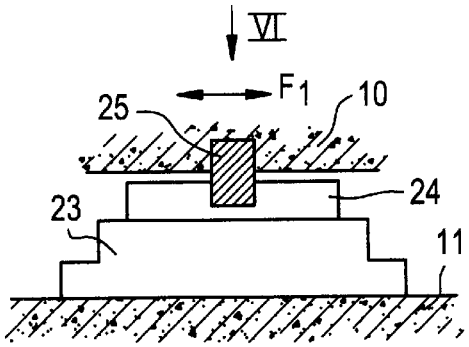
FIG.5 PRIOR ART
Figure 6:
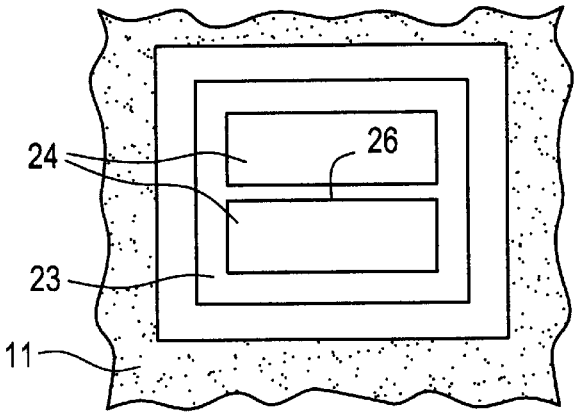
FIG.6 PRIOR ART

FIGS. 5 and 6 show a variant wherein the bridge floor 10 rests on the pier 11 by means of a plate 23 on which is mounted a rail 24 in which engages a key 25, which is itself rigid with the lower face of the bridge floor 10. The key 25 can slide longitudinally in the runner 26 of the rail 24, so enabling the bridge floor to move freely relative to the pier by sliding longitudinally in both directions of the arrow F1. If, instead of a simple key 25, there is provided a crossed key (not shown) penetrating both rails, which are oriented perpendicularly and are rigid with the bridge pier, it will be appreciated that locking is brought about by a fixed point preventing any displacement of the bridge floor relative to the pier at this point. The disadvantage of the system with a fixed point of this type is that, if the key is too strong, in the event of an earthquake or some other violent disturbance, the pier may be destroyed whereas, if the key is designed to shear in such circumstances, then the bridge floor will no longer be held and will be able to move uncontrollably.

Figure 7:
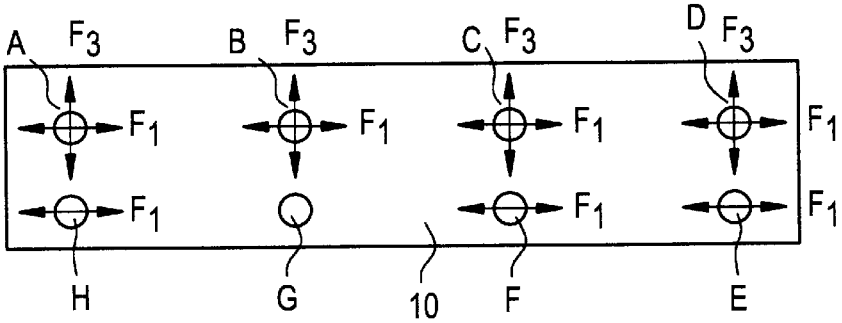
FIG. 7 shows schematically a bridge floor comprising eight support points, of which four permit any relative displacement movement of the bridge floor relative to the support, three permit a longitudinal relative displacement movement of the bridge floor relative to its supports, and one constitutes a fixed point.

In FIG. 7 it is assumed that the bridge floor 10 rests on eight supports designated A to H, respectively. The four supports A, B, C, D are assumed to be sliding supports, permitting any displacement, in particular in the longitudinal direction according to the double arrow F1 and in the transverse direction of the bridge floor according to the direction of the double arrow F3. Such supports can be of the type described and illustrated in FIGS. 2 and 3, for example.

Supports E, F and H are assumed to be supports which permit free displacement in a single direction, that is the longitudinal direction of the bridge floor according to the double arrow F1. They can also be supports of the type illustrated in FIGS. 5 and 6, for example.

Finally, G designates the position of a fixed point about which the bridge floor is anchored relative to the structure. In principle this point should not move relative to the other structure parts which are considered fixed and in particular the support which supports the structure, such as a bridge pier mounted at this location.

Figure 8:
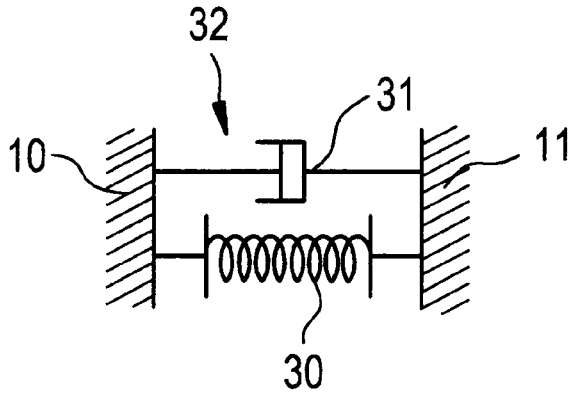
FIG. 8 shows schematically the assembly of a prestressed spring and a damping device used in the construction of a device according to the invention.
Figure 9:
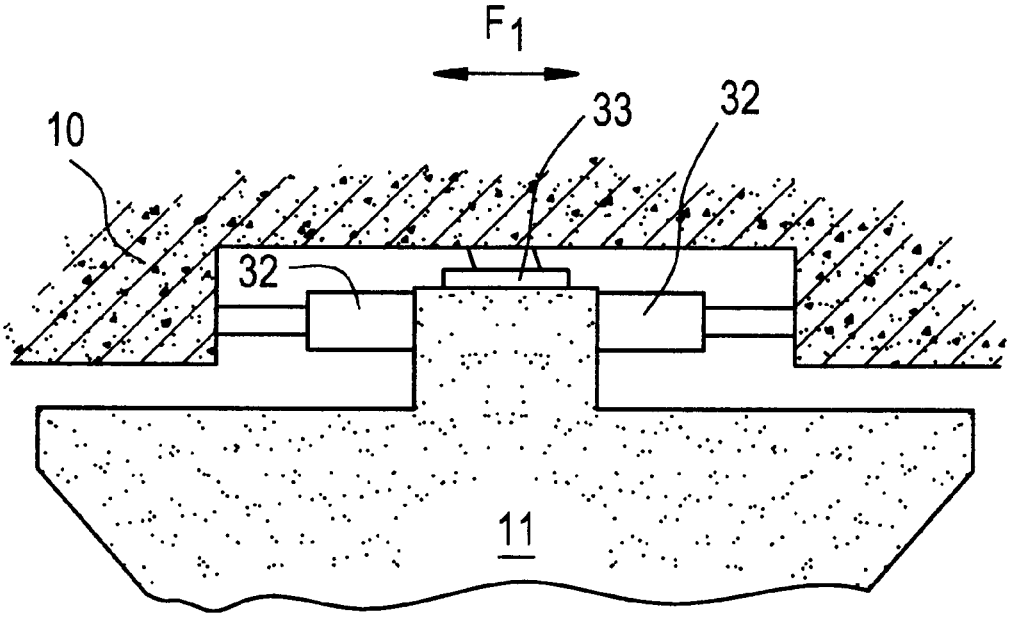
FIG. 9 shows the use of two mechanisms of the type illustrated in FIG. 8, mounted in opposition on a bridge pier and acting on a bridge floor supported by the pier so as to create the "imaginary" fixed point according to the invention.

FIG. 8 shows schematically a part of the device according to the invention which consists of a prestressed spring 30 and a damper 31 mounted between two parts of a bridge, the floor 10 and the pier 11, respectively. A device according to the invention consists of two such device parts, together designated 32. FIG. 9 shows the manner in which two such device parts are mounted in opposition between the bridge pier 11 and the bridge floor supported by the latter.

The bridge floor 10 can be supported on the pier head 11 for example by means of a device 33 of the type with a sliding casing or an elastomer block, as shown in FIGS. 2 and 3, or even by means of a sliding key device, as shown in FIGS. 5 and 6. However, the displacement movement in the direction of the double arrow F1 is countered by the interposition of the two devices 32 each comprising a prestressed spring 30 and a damping device 31. The prestressed springs 30 tend to maintain the pier head and the bridge floor in a fixed relative position by returning the device to the symmetrical central position in which the spring forces are balanced. However, if unusual stress is applied, the bridge floor can slide in the direction of the force applied according to the arrow F1, in order to compress further the spring which will absorb the stress at the same time as the damper 31. When the disturbance has passed, the device will automatically return the bridge floor to the central position.

Advantageously elastomer rubber compression dampers or hydraulic type dampers can be used as damping device 31. It will be appreciated that the prestressing force of the springs is to be calculated as a function of the masses to be damped, in the case in question the mass of the bridge floor. The prestressing force should also be sufficient such that, when the stress is no longer applied, the bridge floor is effectively brought back into position by overcoming the friction forces of the bridge floor on these supports.

Advantageously the device for producing the "imaginary" or "virtual" fixed point according to the invention is preferably mounted towards the centre of the bridge floor, so as to reduce in particular the amplitude of the displacement movements of all the points of the bridge floor.

In the case of a bridge consisting of a plurality of juxtaposed bridge floors, a "virtual" fixed point of the type in question is advantageously provided for each bridge floor.

According to the invention it will be appreciated that, when the disturbance has passed, the fixed point is produced again, such that a "regeneratable" fixed point, as it were, is created.

It will be appreciated that the device can be mounted on the bridge floor in order to damp its longitudinal displacement (direction of arrows F1, FIG. 7) and/or its transverse displacement (direction of arrows F3, FIG. 7).

It should also be noted that, in order to use the device according to the invention, other devices are also required, such as sliding supports of the known, conventional type which support the structure and permit normal movements, in particular thermal expansion, between the structure and its supports in the example shown in FIG. 7, or for example other damping devices which are not, however, intended to return the structure to a fixed point.

We claim:

1. In a civil engineering structure comprising a plurality of supporting parts and a supported part mounted on said supporting parts, at least one supporting part being equipped with a sliding support, which allows motion with respect to the supported part in response to ambient stresses, a device for locking in normal time in position a determined point of the supported structure part relative to a fixed point of one selected supporting part, the device comprising:

at least two prestressed damping springs which are mounted in opposition in a single horizontal degree of freedom on either side of said fixed point of the selected supporting part and acting first on each side of said determined point on the supported structure part and second on the selected supporting part, the prestressing of the springs thus being calculated such that, when the stresses up to a threshold level are applied, the device maintains the selected supporting structure and the supported structure in a fixed relative position at the fixed point of the selected supporting structure, whereas when stresses exceed the threshold value, the device lets the determined point of the supported part to move in the single horizontal degree of freedom relative to the fixed point of the selected supporting part and returns the supported part to its initial position as soon as the stresses exceeding said threshold value cease.

2. A device according to claim 1, comprising displacement dampers which absorb the stresses simultaneously with the prestressed springs.

3. A device according to claim 2, wherein the dampers are of an elastomer rubber compression type.

4. A device according to claim 2, wherein the dampers are of a hydraulic type.

5. A bridge comprising a plurality of bridge floors each resting on a plurality of bridge piers wherein each said bridge floor is supported on piers each comprising a sliding support which supports the bridge floor whilst allowing it a certain degree of freedom relative to a respective bridge pier in response to ambient stresses, said bridge floor also being supported on a selected pier and a device for locking said bridge floor in normal time in position relative to the selected bridge pier, a determined point of said bridge floor being locked relative to a fixed point of the selected bridge pier, the device for locking comprising at least two prestressed damping springs which are mounted in opposition either side of said determined point of the floor and on either side of said fixed point of the selected pier and act first on the bridge floor, and second on the pier, the prestressing of the springs thus being calculated such that, in the absence of stress above a threshold level due to a disturbing action, the device maintains the determined point of the bridge floor fixed with respect to the selected pier, whereas when stresses exceed the threshold value, the device lets the bridge floor to move in a single horizontal degree of freedom relative to the selected pier and returns the floor to its initial position when the disturbing action ceases.

6. A bridge according to claim 5, wherein the locking device is mounted towards the center of the bridge floor.

7. A bridge according to claim 5, wherein the locking device is mounted between the bridge floor and the selected pier, the selected pier having a pier head, a prestressed spring being disposed on each side of the pier head, each spring having one side bearing on the pier head and another side bearing on the bridge floor.

8. A bridge according to claim 7, wherein at least one device comprising two prestressed springs mounted in opposition is with the springs disposed in a longitudinal direction of the bridge floor.

9. A device for cooperating with a civil engineering structure supported on supports, said device comprising a determined point with respect to which said structure may move with respect to the supports of the structure and remain fixed to a selected support in response to usual stresses, said determined point being movable with respect to the selected support in response to unusual stresses, said device comprising:

resilient means connected between said selected support and said civil engineering structure for permitting relative movement therebetween, said resilient means preventing relative motion in response to usual stresses and allowing relative motion in response to unusual stresses.

10. A device according to claim 9, wherein said resilient means comprises prestressed springs.

11. A device according to claim 10, wherein said resilient means further comprises displacement dampers.

12. A device according to claim 11, wherein said displacement dampers are of an elastomeric rubber compression type.

13. A device according to claim 11, wherein said displacement dampers are of a hydraulic type.

14. A method for positioning a bridge comprising floors each resting on a respective plurality supports, comprising the steps of:

permitting motion of each floor in respect to all but one of its supports in a first degree of freedom in response to usual stresses and impeding motion of each floor with respect to a selected one of its supports; allowing said floor to move with respect to the selected support in response to extraordinary stresses; and returning said floor to its initial position in relation to said selected support when the extraordinary stresses are no longer applied.

* * * * *